US005699893A

United States Patent [19]

Spada

[11] Patent Number: 5,699,893

[45] Date of Patent: Dec. 23, 1997

[54] ANGULAR CONVEYOR FOR FRAGILE CYLINDRICAL OBJECTS, IN CIGARETTE PACKING MACHINES

[75] Inventor: Valter Spada, Marzabotto, Italy

[73] Assignee: SASIB S.p.A., Bologna, Italy

[21] Appl. No.: 601,518

[22] Filed: Feb. 14, 1996

[30] Foreign Application Priority Data

Feb. 15, 1995 [IT] Italy ..... GE95A0014

[51] Int. Cl.[6] ..... B65G 29/00

[52] U.S. Cl. ..... 198/478.1; 198/803; 53/234; 414/736

[58] Field of Search ..... 198/470.1, 481.1, 198/803.9, 474.1, 478.1; 53/225, 234; 414/736

[56] References Cited

U.S. PATENT DOCUMENTS

| | | | |
|---|---|---|---|
| 1,539,258 | 5/1925 | Graupner | 198/803.9 X |
| 3,215,249 | 11/1965 | Hastings et al. | 198/470.1 |
| 3,708,371 | 1/1973 | Alie | 198/470.1 X |
| 4,092,816 | 6/1978 | Seragnoli . | |
| 4,936,440 | 6/1990 | Focke et al. | 198/470.1 X |

FOREIGN PATENT DOCUMENTS 1574951 10/1980 United Kingdom .

*Primary Examiner*—Frank E. Werner
*Attorney, Agent, or Firm*—Larson & Taylor

[57] ABSTRACT

An angular conveyor for fragile cylindrical objects, particularly in cigarette packing machines, comprises a wheel (1) provided preferably with a plurality of peripheral cells (101) to house the cigarettes (G), these cells (101) being open at least at the perimeter of the wheel (1), and devices (12) for the at least partial closing of the open perimetrical ends of the cells (101), these devices consisting in particular of pairs of fingers mounted on finger-carrying elements (10) which can be moved alternately between a position of at least partial closure and one of opening of the said ends in synchronization with the steps of advance of the wheel (1), the oscillation of these elements being caused by annular cams (15) substantially coaxial with the wheel (1), these cams (15) being provided on both sides of the wheel (1) and being independent of the rotary motion of the wheel (1). According to the invention, the cams consist of what are known as three-dimensional cams (15). These are preferably of the positive type and are housed in sealed annular chambers (18).

17 Claims, 5 Drawing Sheets

ANGULAR CONVEYOR FOR FRAGILE CYLINDRICAL OBJECTS, IN CIGARETTE PACKING MACHINES

BACKGROUND OF THE INVENTION

The invention relates to an angular conveyor for fragile cylindrical objects, or similar, particularly in cigarette packing machines, comprising:

a wheel supported so that it can rotate about its axis and provided with at least one and preferably a plurality of peripheral cells to house the cigarettes, these cells being open at least at the perimeter of the wheel;

means of driving the wheel, preferably by steps of rotation, in such a way that the cells are brought in succession to predetermined stations having specified angular positions;

means for the at least partial closing of the open perimetrical ends of the cells, which consist in particular of pairs of fingers interacting with partial sections of the two axial ends of the said open perimetrical ends of the cells, and which are movable alternately between a position of at least partial closure and one of opening of the said ends in synchronization with the steps of advance of the wheel;

finger-carrying elements mounted so that they oscillate in accordance with the alternating motion of the fingers, rotate integrally with the wheel on the opposite sides of the wheel, and are driven by annular cams which are substantially coaxial with the wheel, these cams being provided on both sides of the wheel and rotating integrally with each other, but independently of the rotary motion of the wheel, and interacting with cam follower coupling means associated with the finger-carrying elements of the corresponding sides of the wheel;

and on these cams, tracks with configurations which are substantially symmetrically identical to each other and are such that they cause the opening and closing of the cells one or more times or cause them to be kept in the said open and closed condition during their movement along a predetermined arc of the angular path, and/or cause the opening and closing of the cells during their stationary phase in at least one and preferably in at least two different predetermined angular positions of the cells, by means of a relative angular movement of the wheel with respect to the cams.

DESCRIPTION OF THE PRIOR ART

Angular conveyors of this type are widely and intensively used in cigarette packing machines, in which they are used to convey ordered groups of cigarettes inserted in the cells together with wrapping slips from one to another of a plurality of successive stations for folding the said wrapping slip around the group of cigarettes. The folding stations are distributed over a circular path coaxial with the conveyor. Owing to the high operating speed of the said machines, the steps of rotation of the angular conveyor are extremely fast and the groups of cigarettes are subjected to high centrifugal forces tending to expel them from the cells, which are open on the circumference of the conveyor wheels. The means for closing the said open ends which must be removable to permit the insertion and discharge of the groups of cigarettes into and from the wheel are therefore also subject to high operating speeds. The movement of the fingers which close the open ends of the cells must be precise both as regards the synchronization of the movement and as regards the active position and the inactive position of the fingers. In particular, the driving cams and the cam follower means of the closing finger-carrying elements are subject to considerable mechanical wear, and therefore it is useful to reduce to a minimum the relative movements of mutual friction between the cam tracks and the cam follower means interacting with them, in order to avoid the wear of these components and consequently a loss of precision of synchronization and positioning and therefore frequent maintenance operations. Furthermore, at the present time, in conveyor means of the type indicated above, the screening of the cams and cam follower means from the exterior is such that it cannot ensure that the processing waste, such as tobacco dust, paper fragments or other will not dirty the cams, and cannot provide efficient lubrication of the cam tracks and cam follower means. This leads to a progressive loss of precision in the operation of the fingers. A further disadvantage of the known angular conveyors of the said type, and one which also contributes to the loss of operating precision of the closing fingers, consists in the fact that the mechanical coupling between the cam and the finger-carrying elements is not mechanically rigid but has a number of degrees of freedom. This presents a problem because of the considerable operating speed and consequently the considerable speed of rotation of angular conveyors.

SUMMARY OF THE INVENTION

The object of the invention, therefore, is to provide an angular conveyor device of the type described initially, with which, by the use of relatively simple and inexpensive means, it is .possible to avoid the disadvantages described above, while ensuring maximum service life, in other words extremely infrequent maintenance operations, and maximum precision of synchronization and positioning of the cell-closing fingers.

The invention achieves the above objects with an angular conveyor of the type described initially in which the cams are what are known as three-dimensional cams.

Additionally, the cams are of the type known as positive, and interact with a pair of cam follower means acting in opposite directions to each other and associated with each closing finger-carrying element.

In particular, each cam interacts with at least one cam follower roller associated with each finger-carrying element, this roller being supported inside the chamber so that it can oscillate, with its axis in a radial plane parallel to the axis of the cam and of the wheel, about an axis perpendicular to this plane and tangential to the wheel, while the cam has at least one track which consists of an annular surface which extends in a transverse plane with respect to the axis of the wheel and whose shape varies along the circumference in the radial direction (radial variation), in the axial direction (axial variation) and in the transverse inclination with respect to the axis of the wheel (angular inclination), corresponding to an angular offset coaxial with the axis of oscillation of the roller.

Preferably, each cam has two opposing cam tracks which vary in an identical way along the circumference and which have different transverse inclinations with respect to the axis of the wheel, and in particular converge radially outwards in such a way that they form a rib of substantially trapezoidal cross-section, each of these surfaces interacting with a cam follower roller.

Advantageously, the coupling means of the closing finger-carrying elements which carry the two cam follower rollers with the axes angularly offset from each other by an amount equal to the relative inclination between the two opposing cam tracks, are supported movably against the cam tracks so that the two opposing cam tracks are wedged with a certain force between the two cam follower rollers.

According to a further characteristic, each of the two cams operating the fingers which close the cells is housed in an annular chamber which is sealed from the exterior, while the cam follower coupling means of the closing finger-carrying elements are made to pass with a seal into the said annular chamber.

In this way, not only is processing waste prevented from dirtying the cams, but it is also possible to fill the chambers with lubricating fluids so that the cam and the cam follower means operate constantly in a bath of lubricant.

The cams are disposed axially adjacent to the corresponding sides of the wheel, while the annular chambers are formed by two concentric circumferential walls projecting axially and coaxially from the wheel, these circumferential walls rotating integrally with the wheel, and, on the end adjacent to the wheel, by a radial end wall which also rotates integrally with the wheel, while on the opposite end the annular chambers communicate with further chambers sealed from the exterior and corresponding to further rotating parts.

By means of the above arrangements, a coupling is obtained between the cam tracks and the cam follower roller in which the relative slip in the radial direction, in other words in the direction of the axis of the roller between the roller and the associated track, is non-existent or is reduced to a minimum. Furthermore, the mechanical coupling between the said two parts is completely rigid and in particular is easily adjustable to provide optimal operating conditions and to reduce to a minimum the disadvantages due to any play. The whole may be done without requiring any particularly complicated construction.

BRIEF DESCRIPTION OF THE DRAWINGS

The invention also relates to other characteristics which further improve the angular conveyor described above and which form the subject of the dependent claims.

The particular characteristics of the invention, and the advantages derived therefrom, will be more clearly understood from the description of some preferred embodiments of the invention, illustrated by way of example and without restriction in the attached drawings, in which.

DESCRIPTION OF THE PREFERRED EMBODIMENT

Figure 1:
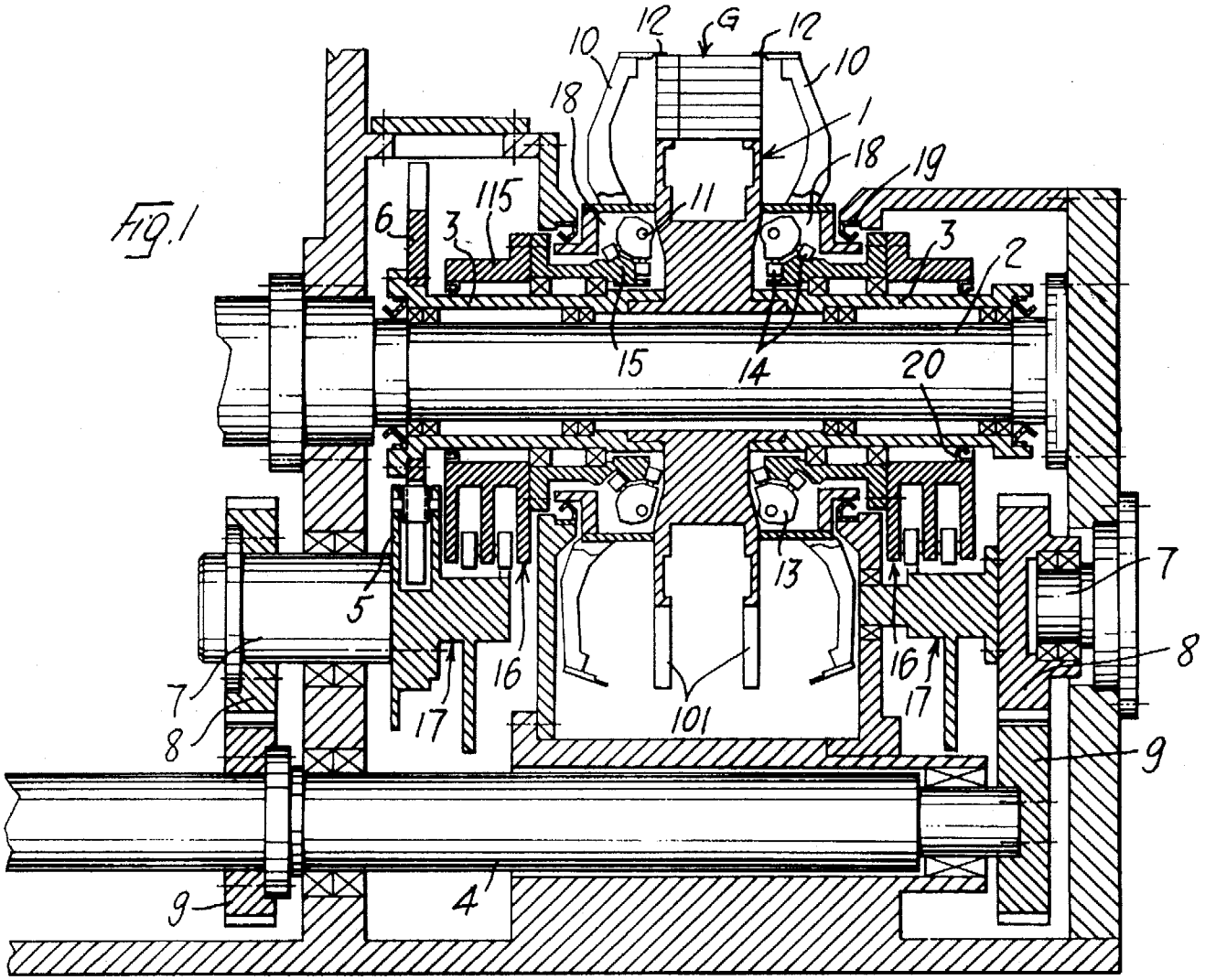
FIG. 1 is a sectional view in a vertical plane passing through the axis of a conveyor wheel according to the invention.

With reference to the figures, a cigarette packing machine, for example a unit for wrapping a slip around an ordered group of cigarettes G, to produce an inner wrapping or a soft or hard pack of cigarettes, comprises a conveyor wheel 1 with a plurality of peripheral cells 101. The cells 101 are spaced apart at equal angular intervals, and are preferably disposed with pairs of diametrically opposite cells, and are orientated radially and are open at least at their radially outer end parallel to the perimetrical side of the wheel 1. The wheel 1 is mounted so that it can rotate about its axis by means of a tubular shaft 3 mounted coaxially on a central axis 2. The tubular shaft 3 extends axially on both sides beyond the sides of the wheel 1 and at one of its ends is connected mechanically to the means of transmission and conversion of the continuous rotary motion of a driving shaft 4 into an alternating rotary motion of the wheel 1 in steps of a predetermined angular size, preferably corresponding to the angular spacing between the cells 101. The means of transmission and conversion may be of any type and are indicated in a general way by the numbers 5, 6, 7, 8 and 9 in FIG. 1.

At the axial end of each cell 101 of the wheel 1, and outside the corresponding side of the wheel, there is provided a radial arm 10 whose free end extends to the periphery of the wheel 1 and which, is mounted so that its radially inner end can oscillate about an axis A perpendicular to the axis and to the corresponding radius of the wheel 1, in other words in the radial plane parallel to and containing the axis of the wheel 1. On its free end, each arm 10 carries a finger 12 projecting towards the corresponding side of the wheel 1 and parallel to the radially outer open end of the corresponding cell 101. The arms 10 are connected mechanically to, and rotate integrally about the same axis A with, coupling means 13, each of which, on the substantially opposite side of the said axis 11, carries a radially inwardly projecting pair of cam follower rollers 14 which are orientated with their axes parallel to the radial plane of oscillation of the corresponding arm 10 and which are angularly out of alignment with each other by a predetermined amount in relation to the axis of oscillation A. The two cam follower rollers 14 interact with a corresponding track of a three-dimensional annular cam 15 which is mounted rotatably with respect to the wheel 1 on the axial projections of the tubular shaft 3, on each side of the wheel 1. The two cams 15 are therefore free to rotate independently of the wheel 1. The two cams 15 are connected mechanically by means of a transmission of a type similar to what is known as an intermittent drive unit with parallel axes. Each cam 15 carries a roller holder 16, interacting with a transmission cam 17 provided with a suitably profiled track for each roller of the roller holder 16, in a radially projecting position in axial alignment with the roller holder of the other cam. The two transmission cams 17 which rotate the two cams 15 operating the oscillating arms 10 are mounted on input shafts 7 which are coaxial with each other and are rotated in phase with each other through gears 8 and 9 by a common driving shaft 4. The driving shaft 4 of the transmission cams 17 is disposed adjacent and parallel to the two opposing input shafts 7 and extends from one to the other of them. In particular, the driving shaft 4 of the transmission cams 17 is the same driving shaft as that which provides the stepping rotation of the wheel 1, different functions of motion transmission, synchronized with each other, being provided for the wheel 1 and for the cams 15 operating the arms 10.

Figure 6:
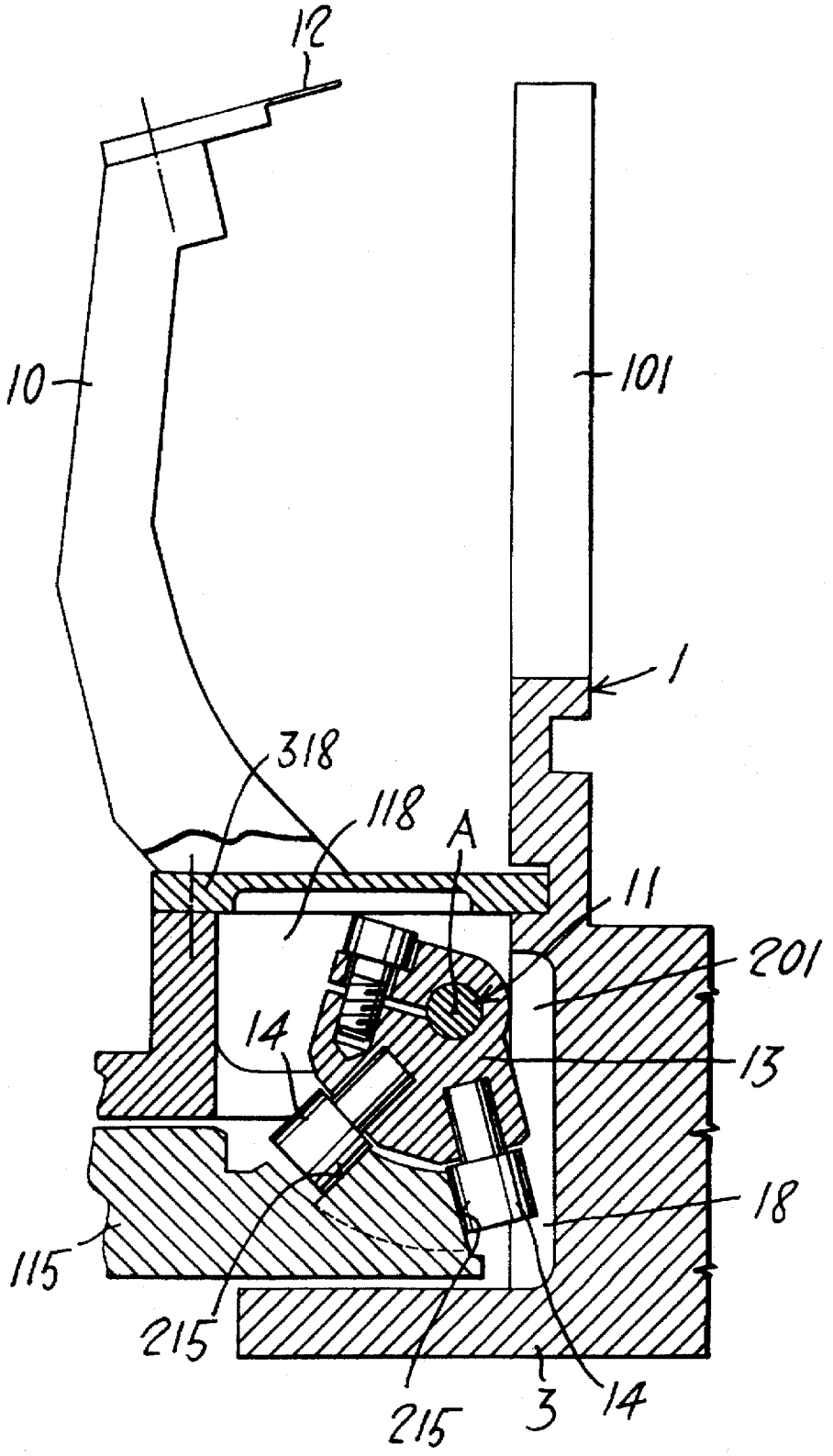
FIGS. 6 and 7 show a section, in an axial plane of the wheel, through an enlarged detail of a finger-carrying arm, in the active and inactive position of the associated finger respectively.
Figure 7:
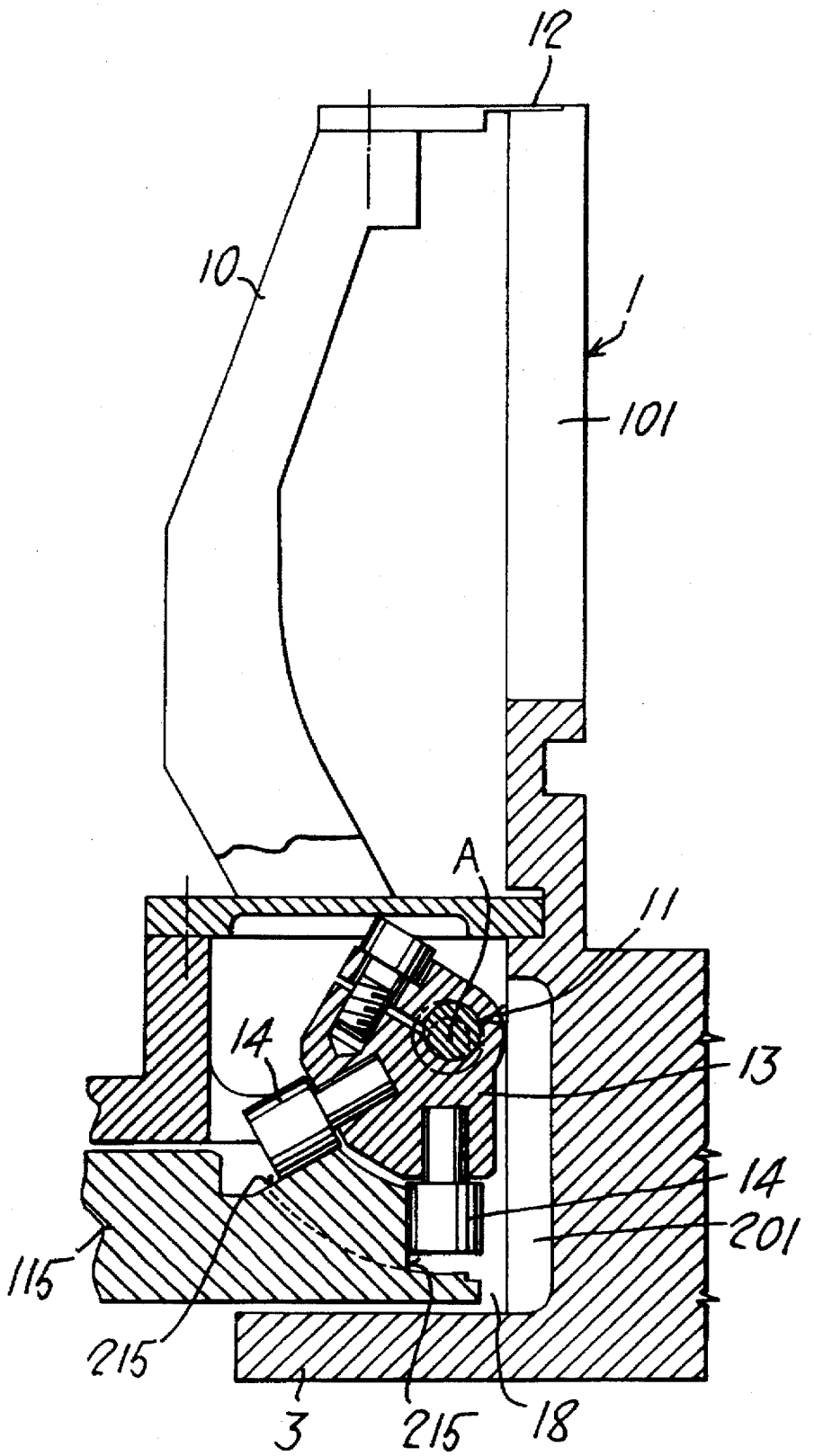

As shown in FIGS. 1, 6 and 7, the two cams 15 operating the arms 10 are housed in annular chambers 18 provided directly adjacent to the sides of the wheel 1 and coaxial with the wheel. The annular chambers 18 are completely sealed from the exterior by means of seals such as scraper rings or similar, indicated by 19 and 20. One part of the walls of each annular chamber 18 is formed by elements rotating integrally with the wheel, while the other part consists of the means of support of the cams indicated by 115. In particular, the radially inner and radially outer circumferential walls of each chamber 18 consist of annular coaxial cylindrical extensions of the wheel 1 which rotate integrally with the wheel, while the axially inner end wall is formed by the corresponding side of the wheel 1. On the opposite end, the chamber 18 communicates with further chambers which can hold lubricating fluids for moving parts and which are also sealed from the exterior.

With particular reference to FIGS. 6 and 7, each cam follower roller 14 associated with an arm 10 interacts with a cam track 215 of the cam 15. The two opposing cam tracks 215 are orientated transversely with respect to the axis of rotation of the wheel and are inclined with respect to each other so that they converge towards each other, in the direction of their radially outer edge, in a way corresponding to the angular offset between the cam follower rollers 14. The two cam tracks 215 form a rib whose two opposing surfaces constitute the cam tracks 215 and which has a trapezoidal cross section. The cam tracks 215 have configurations parallel to each other and are parallel along their circumference. They are annular and coaxial with the wheel 1 and along their circumference their profiles vary both in the radial direction (radial variation) and in the axial direction (axial variation) as well as in respect of their transverse inclination with respect to the axis of rotation of the wheel 1. The variation of inclination (angular variation) corresponds to a rotation, of a predetermined extent, of the said tracks 215 about the axis of oscillation A of the rollers 14 and arms 10.

According to a further characteristic of the invention, the rollers 14 are fitted on, and rotate integrally with, a shaft 11 which coincides with the axis of oscillation A and which is associated with means of moving the rollers 14 against the cam tracks 215 to cause the tracks to be wedged between the rollers 14 with a predetermined pressure.

Figure 2:
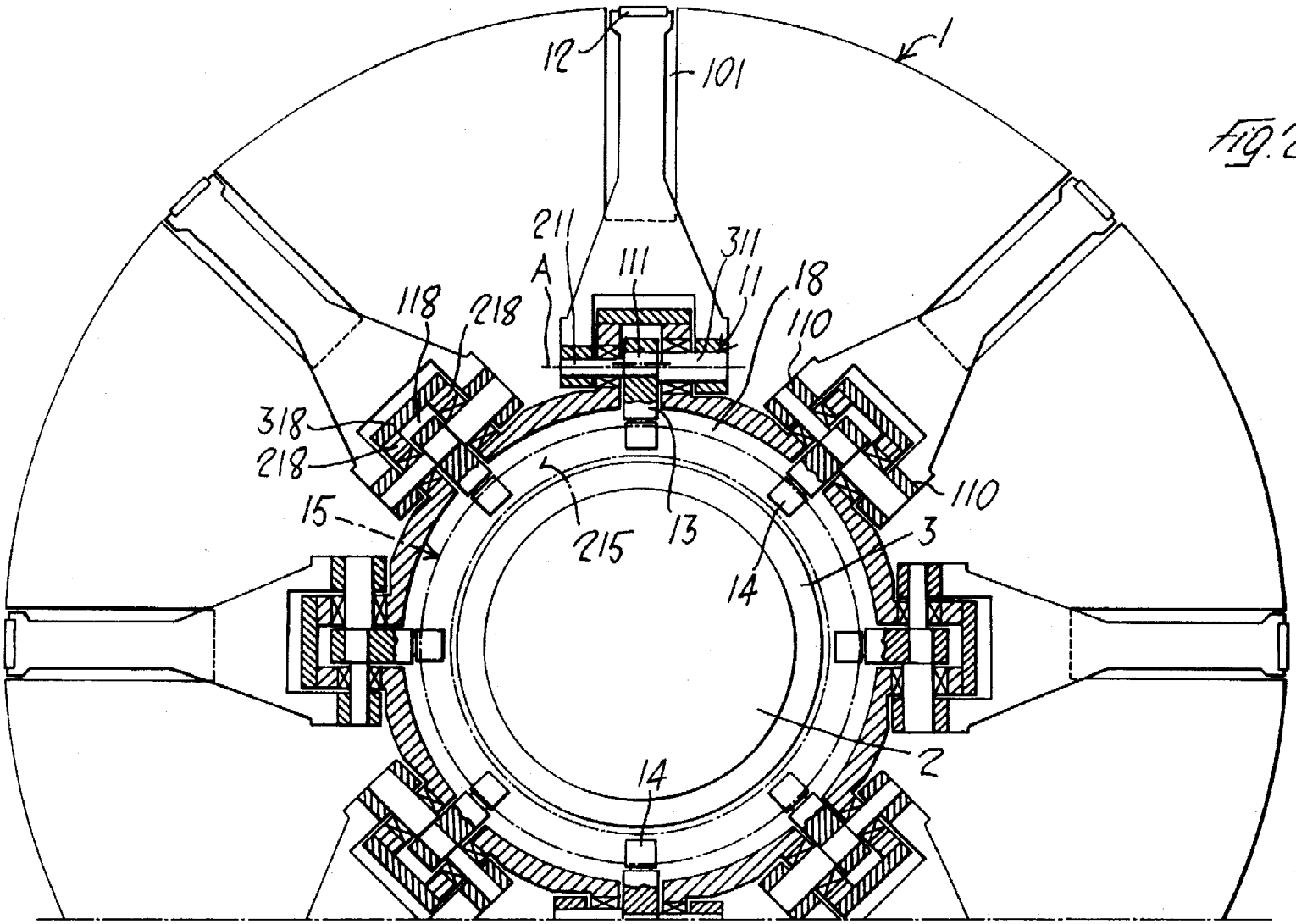
FIG. 2 is a side view of the wheel according to FIG. 1, with the annular chamber for the corresponding cam shown in section.

With reference also to FIG. 2, the shaft coinciding with the axis of oscillation A is supported rotatably and with a seal in radial walls 218 of radial extensions 118 of the annular chambers 18, these extensions 118 being aligned radially with the cells 101. The radial extensions 118 are closed on the radially outer end by a cover 318, while they are open on the radially inner end communicating with the annular chamber 18. The coupling means 13 which carry the rollers 14 and are made in the form of clamps are fixed inside the said extensions 118 on the central part 111 of the shaft 11. The said central part 111 of the shaft 11 is eccentric with respect to the ends 211, 311 of the shaft which are supported in the two radial walls 218 of the extensions 118. These ends 211, 311 are coaxial with each other and project outside the radial walls 218, being engaged and rotating integrally with the corresponding branches 110 of the radially inner fork-shaped end of the arm 10, these branches also being suitably shaped in the form of clamps.

Advantageously, in order to enable the shaft 11 to be inserted into the supporting holes of the radial walls 218 in spite of the central eccentric portion 111 of the shaft, the two coaxial ends 211, 311 of the shaft have different diameters, corresponding to the minimum and the maximum radius of the eccentric element with respect to the common axis A of the two ends 211, 311. The supporting holes for the shaft 11 in the two radial walls 218 of the extensions 118 of the chamber 18 are made coaxial with each other and have diameters corresponding to the associated ends 211, 311 of the shaft 11. Because of this structure, when the clamps of the arms 10 and of the coupling means 13 carrying the rollers 14 are slackened, and the shaft 11 is rotated about its axis, the central eccentric portion 111 causes the two rollers 14 to move to increase or decrease the degree of wedging against the cam tracks 215, without varying the position of the axis of oscillation of the finger-carrying arms 10. Also, when the clamps are slackened, the rotation of the shaft 11 does not cause a misalignment of the oscillation position of the arms 10.

The cam 15 may be made in such a way that a relative rotation of the wheel with respect to it causes the oscillation of the arms 10 between the active position, in which the fingers 12 are superimposed on the cigarettes at the open ends of the cells 101, partially closing the said ends (FIG. 7), and an inactive position, in which the arms are oscillated radially outwards and the closing fingers 12 do not interfere with the cells 101, or in other words are outside the cells (FIG. 6).

When, as in the illustrated example, the wheel 1 is used to convey a succession of groups of cigarettes G, with each of which a folding slip is associated in a predetermined position, from one station for folding the said slip around a group of cigarettes G to the next, it may be advantageous not to bring the fingers 12 for closing the open ends of the cells 101 into the inactive position during the folding of the flaps of the slip on to the corresponding sides of the group of cigarettes, in order to avoid the retardation of the folding phases. In this case, after the group of cigarettes G has been completely wrapped in a tubular wrapping, the closing fingers 12 must be brought into the inactive position to enable the folding of the slip to be completed at the ends and/or to enable the group of cigarettes, wrapped in the slip, to be discharged from the wheel 1. The fingers 12 are therefore disposed between the flaps of the slip and the group of cigarettes, and consequently the move to the inactive position must be executed without the possibility of causing a radial outward movement of the closing fingers 12 because of their oscillation on the arms 10. For this purpose, the axis of oscillation A of the arms 10, in other words the axis of the shaft 11, is disposed in a position as close as possible axially to the plane defined by the ends of the cells 101, in this case the corresponding side of the wheel 1. For this purpose, the radial extension 118 of the annular chamber 18 for the cam 15, in which extension the roller holder coupling element 13 is housed, is continued axially by a cavity 201 in the corresponding side of the wheel 1 to enable the said roller holder coupling element 13 to oscillate into the axially inner position in which the arms 10 are moved away from each other. Additionally, the fork-shaped ends 110 of the arms 10 are inclined towards the said side of the wheel i and they have a substantially curved shape with their inner surfaces facing the wheel 1.

Figure 4:
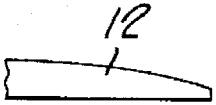
FIG. 4 is a detail of a section in the axial direction of the wheel of a closing finger.

Since the axis of oscillation A cannot be approached to the ideal position, the ends of the fingers 12 are made tapered, preferably in a curved way, and to a degree sufficient to compensate for any residual radially outward movement (FIG. 4).

Figure 5:
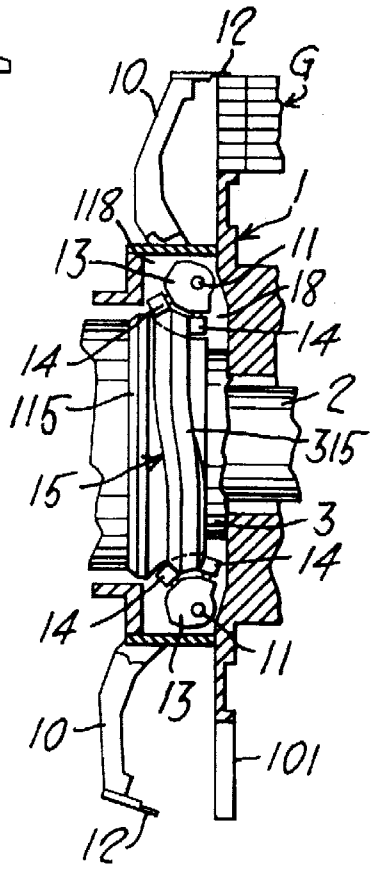
FIG. 5 is an axial section of part of the wheel, with the helical connecting segments of the corresponding cam visible.
Figure 3:
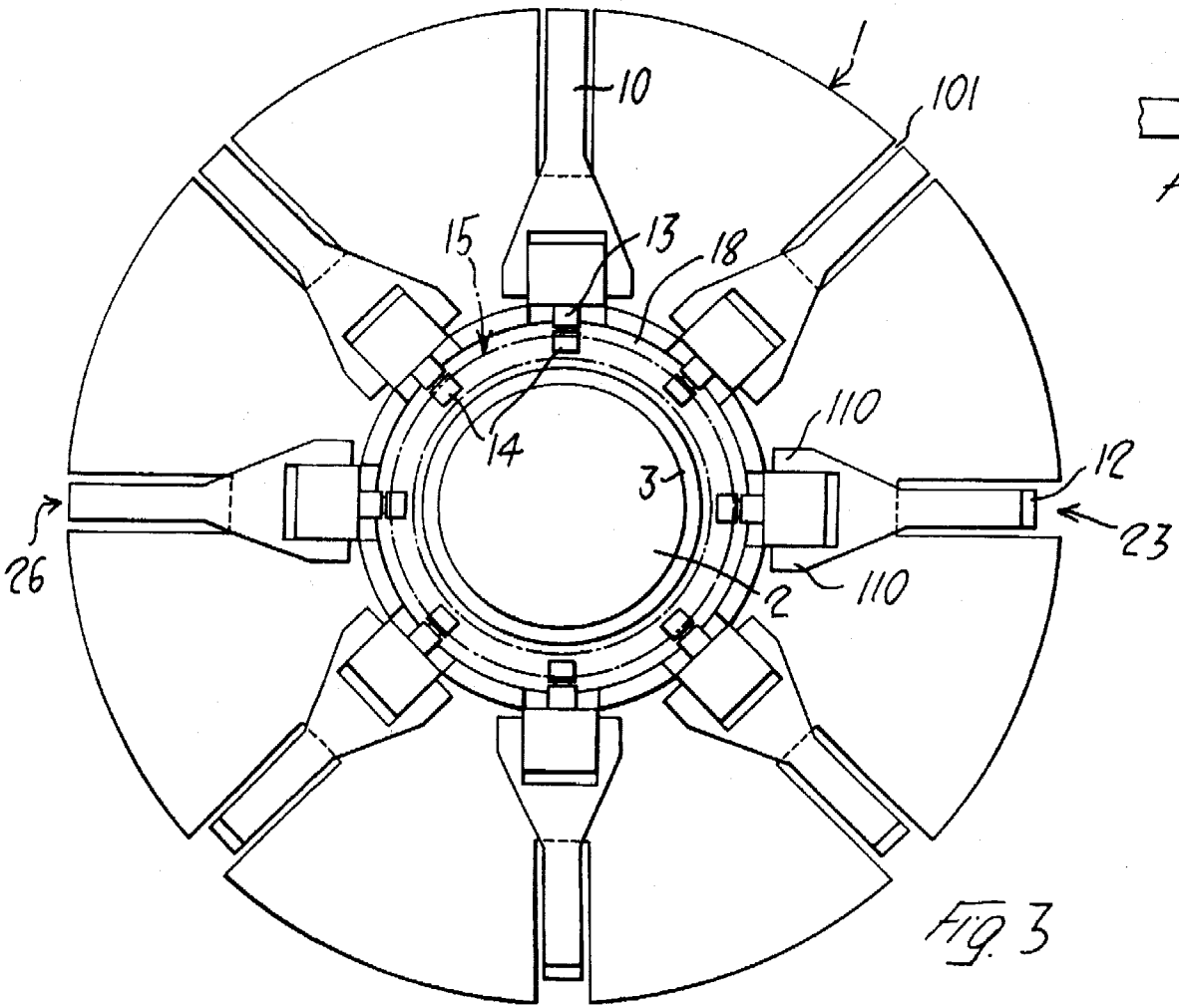
FIG. 3 is a schematic side view on a reduced scale of the wheel according to the preceding figures, with the arms in the active and inactive closing positions around the circular path of the cells.

As regards the cam 15, with reference to FIGS. 3 and 5, this may be shaped in any way according to the operational requirements.

In particular, in a conveyor wheel 1 of a unit for folding a wrapping slip around a group of cigarettes, the folding stations may be limited to a substantially semicircular upper path which extends for approximately 180° from a feed station 25 in which the cell is horizontal to a diametrically opposite discharge station 26, while in the lower semicircular return path of the cells 101 the cells are empty. In this case, the cells 101 must remain closed along the upper semicircular path from the feed station 25 to the discharge station 26, and may remain open over the lower semicircular return path, while they must be alternately open and closed when they are in the feed station 25 and the discharge station 26 respectively. To achieve this operation, the invention provides a cam 15 of the type described previously, which has two opposing sectors extending substantially over the angular extent of the two paths. Along the said two opposing sectors, the tracks 215 of the cam 15 have a radial position, axial position and transverse inclination with respect to the axis of the wheel which are constant and correspond to the two maximum and minimum values of radial, axial and angular variation of the tracks, as indicated in the two sections in FIGS. 6 and 7. In the area of the two stations 25, 26, the two cam sectors are connected by a connecting portion 315 which as indicated in FIG. 5 has a substantially helical configuration. The total angular size of the two opposing sectors associated with the upper and lower paths of the cells 101 is less than 360° and more than 180°, and is preferably approximately 270°, while the two helical connecting portions 315 of the tracks 215 of the cam 15 in which the tracks change from one to the other of the two extreme conditions of radial position, axial position and transverse inclination, are substantially of equal angular size and extend over the remainder of the part required to complete the annular cam tracks 215.

In particular, the connecting portions 315 have an angular size which corresponds substantially to the angular spacing between the cells 101, and is preferably slightly smaller, and the cam 15 can oscillate in relation to the wheel 1 and about its axis in the two directions over the said angular size. The angular disposition of the cam 15 with respect to the wheel 1, the disposition of the connecting portions 315 and their angular size and the angular size of the rotation of the cam 15 with respect to the wheel 1 are determined in such a way that for each step of rotation it is possible to move the fingers 12 associated with the cell 101 into the inactive open position at the discharge station 26 and to move alternately those of the cell 101 into the inactive open position at the feed station 25 during the stopping phase of the wheel 1, while immediately before the step of rotation of the wheel or immediately at the start of the said step the fingers 12 associated with the cell 101 at the feed station 25 are brought into the active position of closing the cell, being kept in the said position along the whole of the upper path along which the folding of the slip is carried out.

I claim:

1. Angular conveyor for fragile cylindrical objects in cigarette packing machines, comprising:

a wheel supported so that it can rotate about its axis and provided with at least, one and preferably a plurality of peripheral cells to house cigarettes, these cells being open at least at a perimeter of the wheel;

means driving the wheel by steps of rotation, in such a way that the cells are brought in succession to predetermined stations having specified angular positions;

means to at least partially close the open perimetrical ends of the cells, which consist of pairs of fingers interacting with partial sections of two axial ends of the said open perimetrical ends of the cells, and which are movable alternately between a position of at least partial closure and one of opening of the said ends in synchronization with the steps of advance of the wheel;

finger-carrying elements mounted so that they oscillate in accordance with the alternating motion of the fingers, rotate integrally with the wheel on opposite sides of the wheel, and being driven by annular cams which are substantially coaxial with the wheel, these cams being provided on both sides of the wheel and rotating integrally with each other, but independently of the rotary motion of the wheel, and interacting with cam follower coupling means associated with the finger-carrying elements of corresponding sides of the wheel;

tracks mounted on the cams and having configurations which are substantially symmetrically identical to each other and are formed such that they cause the opening and closing of the cells one or more times; or cause the cells to be kept in the said open and closed condition during their movement along a predetermined arc of the angular path; and/or cause the opening and closing of the cells during their stationary phase in at least one and preferably in at least two different predetermined angular positions of the cells, by means of a relative angular movement of the wheel with respect to the cams, characterized in that the cams are formed as three-dimensional cams.

2. Conveyor according to claim 1, characterized in that the cams are of a positive type, and interact with a pair of cam follower means acting in opposite directions to each other and being associated with each closing finger-carrying element.

3. Conveyor according to claim 1, characterized in that each cam interacts with at least one cam follower roller associated with each finger-carrying element, the roller being supported so that it can oscillate, with its axis in a radial plane parallel to an axis of the cam and of the wheel, about an axis perpendicular to the plane and tangent to the wheel, while the cam has at least one said track which consists of an annular surface which extends in a transverse plane with respect to the axis of the wheel and whose shape varies along a circumference in the radial direction, in the axial direction and in a transverse inclination with respect to the axis of the wheel (angular inclination), corresponding to an angular offset coaxial with the axis of oscillation of the roller.

4. Conveyor according to claim 3, characterized in that each cam has two opposing cam tracks which vary in an identical way along the circumference and which have different transverse inclinations with respect to the axis of the wheel, and in particular converge radially outwards in such a way that they form a rib of substantially trapezoidal cross-section, each of these surfaces interacting with the cam follower roller associated with the same finger-carrying element, the said two rollers being angularly offset from each other in the plane of oscillation by an amount corresponding to the relative inclination of the two opposing cam tracks.

5. Conveyor according to claim 1, characterized in that the coupling means of the finger-carrying elements carry two cam follower rollers with the axes angularly offset from each other by an amount equal to the relative inclination between two opposing cam tracks and are supported movably against the cam tracks so that the two opposing cam tracks are wedged with a particular force between the two cam follower rollers.

6. Conveyor according to claim 1, characterized in that the finger-carrying members and the associated coupling means are fixed removably on, and rotate integrally with, a common shaft, this shaft having a portion eccentric with respect to an axis of oscillation and at least one portion coaxial with the said axis of oscillation, the finger-carrying members being lockable to the said coaxial portion so that they rotate integrally with it, and the coupling means which carry rollers being lockable on the said eccentric portion in such a way that, when the system for locking the said two parts on the shaft is loosened, the shaft may be rotated freely with respect to the said parts.

7. Conveyor according to claim 6, characterized in that the shaft has two ends coaxial with each other and with the axis of oscillation, and an intermediate eccentric portion, the two coaxial ends having different diameters corresponding to minimum and maximum radial distance of the eccentric portion from the axis of oscillation respectively, while the shaft is supported rotatably with its two coaxial portions in radial ribs integral with the wheel and coinciding with the cells between which a central eccentric portion is interposed, each finger-carrying member being fixed on the two coaxial ends of the shaft projecting outside the radial ribs with two branches in the form of a clamp of a radially inner fork-shaped end of the finger-carrying member, and the coupling means being in the form of a clamp locked on the eccentric portion in an intermediate position between the two radial ribs.

8. Conveyor according to claim 1, characterized in that an axis of oscillation of each finger-carrying member is comprised of a shaft and is in a position axially proximate to a corresponding axial end of the cells.

9. Conveyor according to claim 8, characterized in that in an area of the coupling means which carry rollers, the wheel has cavities axially coinciding with the coupling means.

10. Conveyor according to claim 9, characterized in that ends of the fingers are tapered so that they become thinner towards their free ends, to compensate for any radially outward movement of the fingers along an arc of oscillation between the two positions.

11. Conveyor according to claim 10, characterized in that the fingers are tapered with a curve on their radially outer sides, corresponding to an arc of their circle of oscillation.

12. Conveyor according to claim 1, characterized in that the predetermined stations comprise a station for feeding the cigarettes to and a station for discharging the cigarettes from the cells of the wheel by means of a radial movement with respect to the wheel, these stations being disposed so that they are angularly offset from each other and diametrically opposite each other and having two circular paths, one from the feed station to the discharge station and one for the return from the discharge station to the feed station, these paths being substantially diametrically opposite, the closing fingers being kept in a constantly active position in which they close the cells, or in a constantly inactive position in which the cells are open, along the said two paths, the cam tracks along the said two paths consisting of annular segments which have the two extreme radial, axial and angular inclination positions which are constant over an angular extension, while the said two segments of the cam tracks are connected at their two ends by means of connecting portions in which the cam tracks vary from one to the other of the two extreme positions with a substantially helical configuration, the said connecting portions having an angular size approximately corresponding to an angular spacing between the cells, and being disposed in angular positions between the two annular segments such that they enable the closing fingers to be moved alternately to the active position and to the inactive position or vice versa during the stationary phase of the wheel, at least or solely for the cells at the feed station and discharge station, by means of an angular offset of the cams with respect to the wheel, in two directions of rotation, namely opposite and identical to that of the wheel.

13. Conveyor according to claim 1, characterized in that both the cams operating the opposing finger-carrying members are driven by a single driving shaft which is connected mechanically to each cam by means of a separate transmission consisting of an intermittent drive unit with parallel axes for each cam.

14. Conveyor according to claim 13, characterized in that the driving shaft of the cams operating the finger-carrying member is also a driving shaft of the wheel (1).

15. Conveyor according to claim 1, characterized in that each of the two cams operating the fingers which close the cells is housed in an annular chamber which is sealed from an exterior thereof, while the cam follower coupling means of the closing finger-carrying members are made to pass with a seal into the said annular chamber.

16. Conveyor according to claim 15, characterized in that the cams are disposed axially adjacent to corresponding sides of the wheel, while the annular chambers are formed by two concentric circumferential walls projecting axially and coaxially from the wheel, these circumferential walls rotating integrally with the wheel, and, on an end adjacent to the wheel, by a radial end wall which also rotates integrally with the wheel, while on the opposite end, the annular chambers communicate with further chambers sealed from the exterior and corresponding to further rotating parts.

17. Conveyor according to claim 16, characterized in that each annular chamber has a radial extension which is radially aligned with a corresponding cell and in which are housed the means for coupling the finger-carrying members to the cam, each of these finger-carrying members having a fork-shaped end embracing the radial walls of the radial extensions of the, corresponding annular chamber with the shafts being housed with their axes perpendicular to the said radial walls with the ends for connection to the finger-carrying members projecting outside these walls on both sides of the radial extensions, and the coupling means being housed in the said radial extensions of the annular chambers.

* * * * *